United States Patent [19]

Woidich et al.

[11] Patent Number: 4,854,260

[45] Date of Patent: Aug. 8, 1989

[54] CONFIGURATION OF DISCHARGE TUBES, EJECTION TUBES OR RECEPTACLES IN SUBMARINES

[75] Inventors: Richard Woidich, Altenholz; Werner Toobe, Kiel, both of Fed. Rep. of Germany

[73] Assignee: Krupp MaK Maschinenbau GmbH, Kiel, Fed. Rep. of Germany

[21] Appl. No.: 174,767

[22] Filed: Mar. 29, 1988

[30] Foreign Application Priority Data

Apr. 2, 1987 [DE] Fed. Rep. of Germany ..... 3711059

[51] Int. Cl.[4] ..... B63G 8/28

[52] U.S. Cl. ..... 114/316; 89/1.81

[58] Field of Search ..... 114/316, 317; 89/1.8, 89/1.809, 1.81, 1.816, 1.819, 5

[56] References Cited

U.S. PATENT DOCUMENTS

| | | | |
|---|---|---|---|
| 1,242,768 | 10/1917 | Cerio | 114/319 |
| 3,087,386 | 4/1963 | Rung et al. | 114/317 |
| 3,301,132 | 1/1967 | Lehmann et al. | 114/316 |
| 3,356,056 | 12/1967 | Lehmann | 114/317 |
| 3,732,840 | 5/1973 | Dane | 114/249 |

*Primary Examiner*—Sherman D. Basinger
*Assistant Examiner*—Stephen P. Avila
*Attorney, Agent, or Firm*—Nils H. Ljungman

[57] ABSTRACT

The invention relates to a configuration in which bodies, such as, torpedoes, to be delivered, can be held in an additional container inside a torpedo tube in a submarine. This container is in the manner of an interior tube. The annular space, between the torpedo and its tube thereby formed, is used to hold damping elements, which are located individually or over the entire structure of the torpedo, and the annular space is kept free of water by means of appropriate sealing elements. There is another damping element in the rear portion of the container in the torpedo tube.

18 Claims, 4 Drawing Sheets

CONFIGURATION OF DISCHARGE TUBES, EJECTION TUBES OR RECEPTACLES IN SUBMARINES

BACKGROUND OF THE INVENTION

1. Field of the Invention:

This invention relates to a type of a discharge tube, ejection tube or receptacle in a submarine for the storage, transport and launching or ejection of the bodies to be delivered, such as torpedoes, missiles, mines, etc.

2. Description of the Prior Art:

There are configurations of this type with rigidly mounted guides, which during the explosion of mines and depth charges, especially in the proximity of the submarine, have the disadvantage that the full and unacceptably high shock stresses are transmitted to the bodies to be delivered, which are preferably the torpedoes, missiles, mines, etc. resting in their discharge tubes, ejections tubes or receptacles.

OBJECT OF THE INVENTION

The object of the invention is to use a simple apparatus to reduce the high shock stresses transmitted to the torpedoes, missiles, mines, etc. being carried, and to achieve this object independently, whether the discharge tube has water therein or not.

SUMMARY OF THE INVENTION

This object is achieved by the invention, in that the bodies to be delivered can be placed in a container designed as an interior tube located in an annular space, and the annular space is used in whole or in part to hold damping elements.

As a result of this configuration, the high shock stresses which occur can be reduced to an acceptable level in a simple manner. The annular space is also kept entirely or partly free of water, preferably by the actions of the damping elements.

To realize this configuration, the invention proposes that an elastic body preferably be used which can be compressed in the axial direction be located in the rear portion of the container. In one special configuration, the elastic body is designed as a flexible tube which can be filled with compressed gas.

In an advantageous configuration, the damping elements in the annular space are formed by individual flexible shock damping elements, and the annular space is sealed off by means of sleeve packings. In this manner the annular space is kept entirely or partly free of water.

Alternatively, it is proposed that the annular space comprises an elastic support over its entire structure.

In order not to change the position of the calibration axis in response to different loads, the damping elements are installed with a prestress for the adjusted support of the interior tube.

To achieve an adjusted support of the interior tube, the position of the interior tube can be mechanically fixed by means of a centering apparatus for the loading and discharge or ejection of the bodies.

In general, the invention features a launch apparatus for a submarine for launching a weapon, the launch apparatus including: a launch tube arrangement having an interior cavity for receiving a weapon, the interior cavity having an inner surface region; the launch tube arrangement having an arrangement for mounting the launch tube arrangement in a submarine; an arrangement for being disposed within the interior cavity in an annular space between the tube and a weapon and for making contact with the inner surface region of the launch tube and also for making contact with and holding a weapon disposed in the tube; the annularly disposed arrangement comprising an annularly disposed resilient arrangement for resiliently holding a weapon within the interior cavity of the launch tube arrangement.

Embodiments of the invention are schematically illustrated in the accompanying drawings.

DESCRIPTION OF THE PREFERRED EMBODIMENTS

Figure 1:
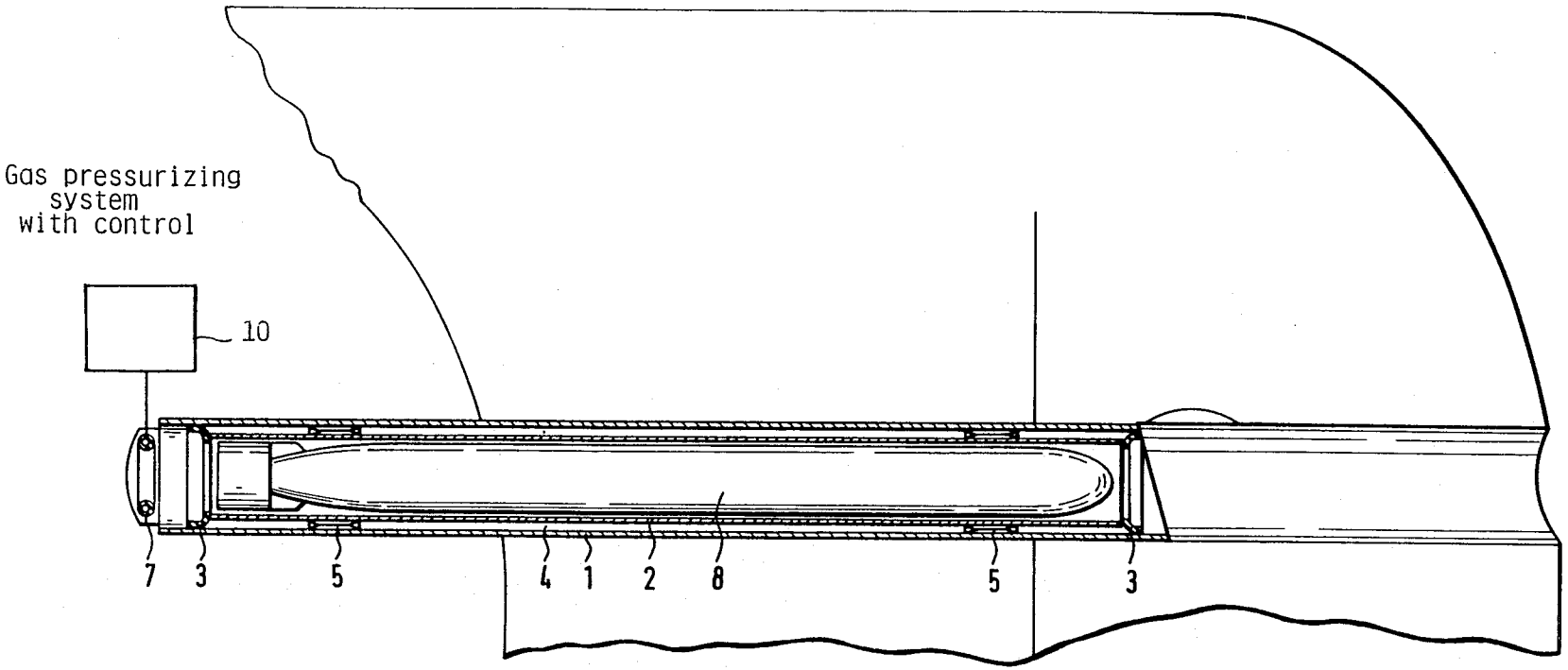
FIG. 1 shows a configuration with an interior tube supported by elastic shock damping elements.

In the illustrated embodiments of the invention, a discharge or ejection tube 1 is fixed in position in a submarine, as shown in FIG. 1. Further, with regard to FIG. 1, to guide a torpedo 8, there is an additional interior tube 2, which is elastically supported by means of spring shock absorbing elements 5 and 6 which act in the radial and axial direction to support the discharge or ejection tube 1 itself. The spring elements 5 and 6 may be in the form of metallic springs preferably with one set of plates or the like making contact with the tube 2 and another set of plates making contact with the torpedo or other body 8; alternatively, elastomeric bodies, made from an elastomeric material which absorbs shock could be used for the spring elements 5 and 6, which elastomeric bodies are molded to conform to the tube 2 and the torpedo, etc., 8.

Figure 2:
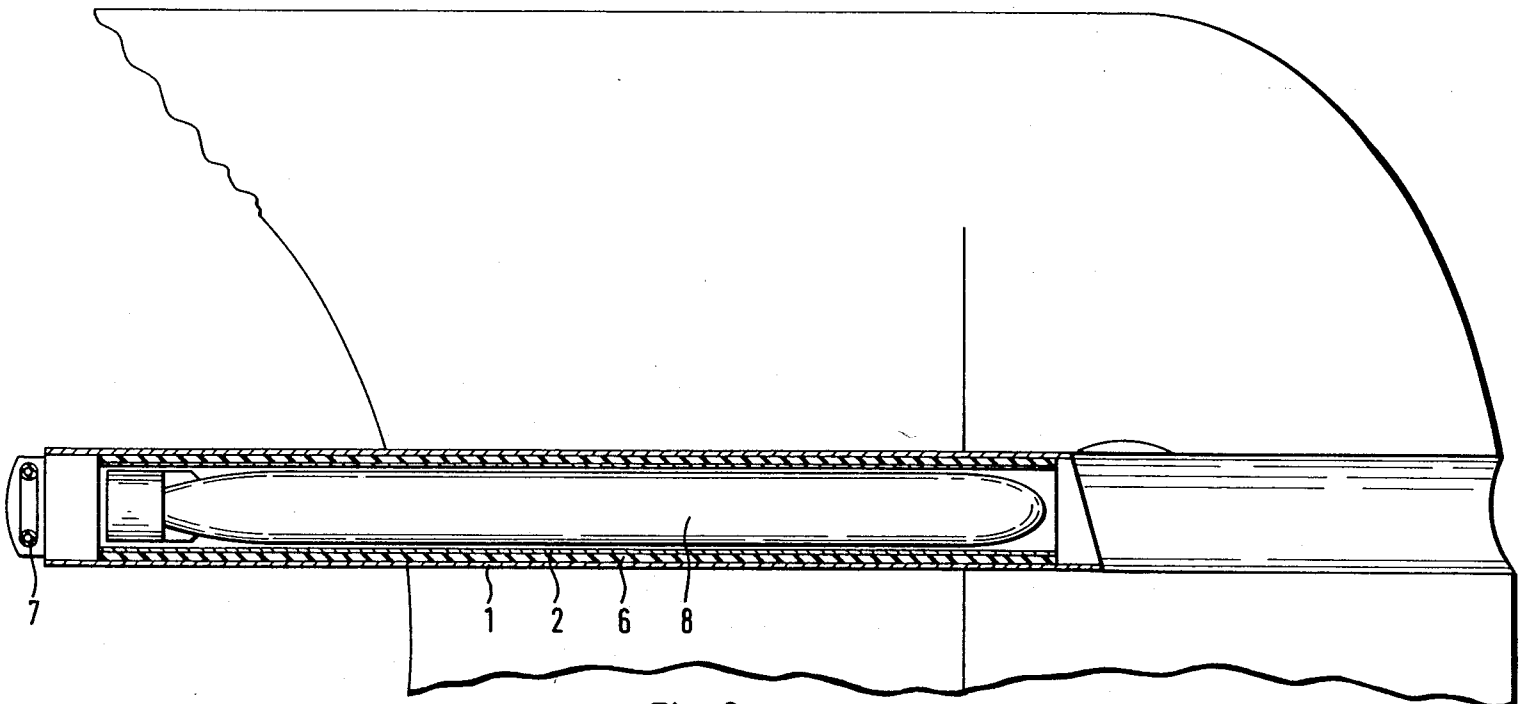
FIG. 2 shows a configuration like that in FIG. 1, with an elastic support over the entire structure of the interior space.

As shown in FIG. 1, the annular space 4 formed has individual elastic shock damping elements 5, while, as shown in FIG. 2, the entire structure of the annular space 4 has an elastic support 6. The elastic support 6 is preferably constructed in the same manner as described supra.

The annular spaces are themselves sealed by means of elastic sleeve packings 3 or by the elastic support 6 which runs over the entire length of the interior tube 2, so that the annular space 4, even when subjected to water pressure at the maximum diving depth of the submarine, is kept substantially and preferably even completely free of water, and thus the interior tube 2, together with the body 8 to be delivered, can be supported in the radial direction, unhindered by water. The elastic sleeve packings 3 are preferably of a type which are used for sealing the ends of tubes or of a marine variety well known in the prior art. These packings 3 may be made of an elastomer or a combination of metal and elastomer and a rigid plastic. One embodiment of the packing 3 may be a disc with an elastomeric outer region which can be compressed to seal against the inner surface of the tube 2.

To reduce the shock in the axial direction, there is a flexible tube 7 designed as an elastic cavity which can be filled with compressed gas such as air. This flexible tube 7 may also be spring loaded with a spring as above or also made of an elastomeric material as also described above. In the presence of stress, by means of its elastic deformation, it creates a corresponding suspension space for the water displaced in the axial direction for the body 8 to be delivered and the interior tube 2.

In FIG. 1 there is also shown a gas pressure system with a control 10 for pressurizing the flexible tube 7 by means of compressed gas.

Figure 3:
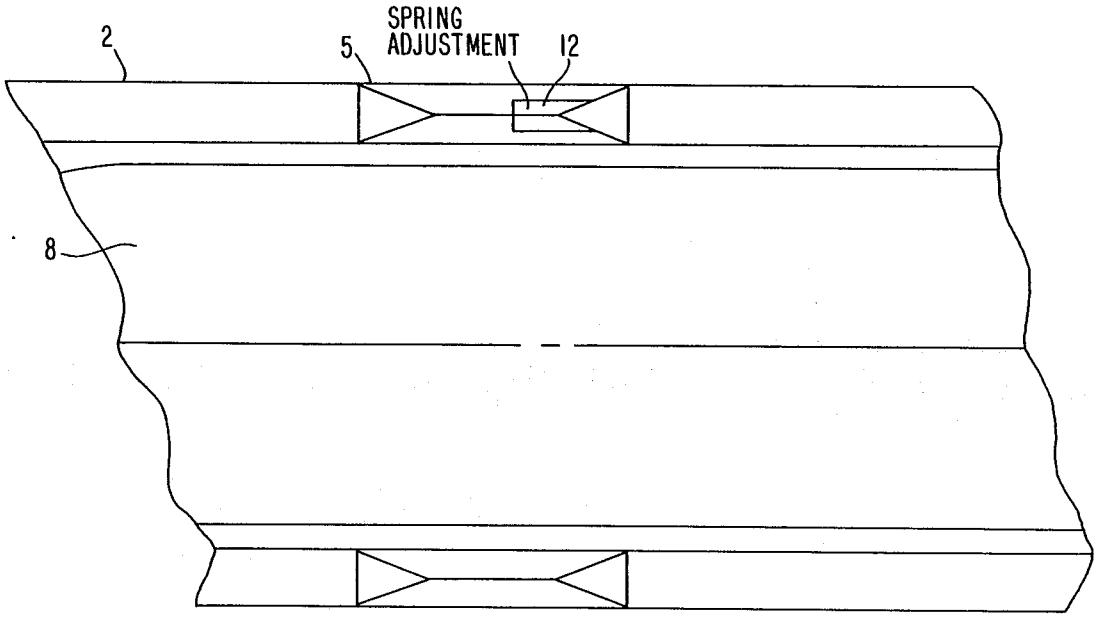
FIG. 3 shows a configuration like that in FIG. 1, with an adjustment for a spring system in the interior tube.

FIG. 3 shows a spring adjustment 12 for one of the individual elastic shock damping elements 5 which can vary the gripping of the weapon in the tube 2.

Figure 4:
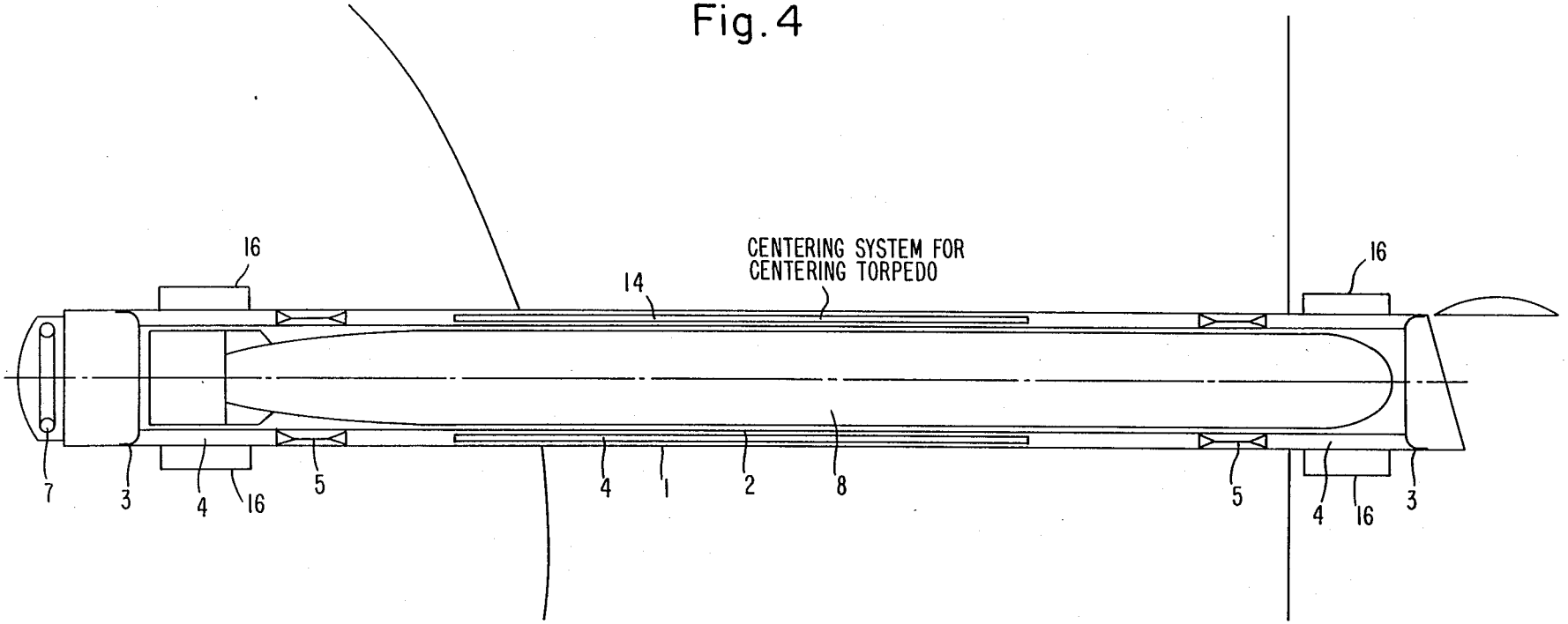
FIG. 4 shows a configuration like that in FIG. 1, with a centering system for centering a weapon in the interior tube.

FIG. 4 shows a centering system 14 for mechanically centering a weapon during loading and also preferably during the discharge or launching thereof. A mounting arrangement 16 is also shown, which mounts the torpedo or launch tube 2 to the submarine. The torpedo or launch tube 2 may be horizontal as shown or vertical or mounted at an angle between vertical and horizontal.

In summing up, one embodiment of the invention relates to a configuration of discharge tubes, ejection tubes or receptacles in submarines for the storage, transport and launching or ejection of the bodies to be delivered, such as torpedoes, missiles, mines, etc., wherein the bodies 8 to be delivered can be held in a container 2 which is designed as an interior tube, which is located so that an annular space 4 is formed, and the annular space 4 is used in whole or in part to hold damping elements 5 or 6.

Another embodiment of the invention relates to the rear portion of the container 2 having an elastic body 7 which can be compressed in the axial direction of the elastic body 7.

Yet another embodiment of the invention relates to the elastic body 7 being designed as a flexible tube which can be pressurized with compressed gas.

Still yet another embodiment of the invention relates to the damping elements in the annular space being formed by individual flexible shock damping elements 5, and the annular space 4 being sealed by means of at least one sleeve packing 3.

Yet a further embodiment of the invention relates to the annular space 4 having an elastic support 6 over its entire structure.

Still yet a further embodiment of the invention relates to the damping elements 5 being prestressed for the adjusted suspension of the interior tube 2.

An additional embodiment of the invention relates to the position of the interior tube 2 being mechanically fixed by means of a centering apparatus for the loading and discharge of launching of the body 8.

An example of a patent relating to a torpedo launcher is U.S. Pat. No. 4,523,538, entitled "Torpedo Launcher", which is incorporated herein by reference as if the entire contents thereof were fully set forth herein.

The invention as described hereinabove in the context of the preferred embodiments is not to be taken as limited to all of the provided details thereof, since modifications and variations thereof may be made without departing form the spirit and scope of the invention.

What is claimed is:

1. A launch apparatus for a submarine for launching a weapon, said launch apparatus comprising:

launch tube means having an interior cavity for receiving a weapon;

said interior cavity having an inner surface region;

said launch tube means having means for mounting said launch tube means in a submarine;

means being disposed within said interior cavity in an annular space between said tube and a weapon and making contact with said inner surface region of said launch tube and also for making contact with and holding a weapon disposed in said tube;

said annularly disposed means comprising annularly disposed resilient means for resiliently holding a weapon within said interior cavity of said launch tube means; and an elastic body being disposed at an inner portion of said launch tube means for resiliently, axially loading a rear portion of a weapon along a longitudinal axis of a weapon disposed in said tube means, said elastic body being disposed for making contact over a substantial part of a rear portion of a weapon disposed in said tube means.

2. The launch apparatus according to claim 1, wherein said annularly disposed resilient means has means for making contact with at least a portion of a weapon disposed in said tube.

3. The launch apparatus according to claim 1, wherein said elastic body has a gas cavity for receiving pressurized gas and means for providing pressurized gas to said elastic body to provide gas to said gas cavity thereof.

4. The launch apparatus according to claim 1, wherein said elastic body has a gas cavity for receiving pressurized gas and means for providing pressurized gas to said elastic body to provide gas to said gas cavity thereof.

5. The launch apparatus according to claim 4, wherein said annularly disposed resilient means comprises individual, shock damping elements.

6. The launch apparatus according to claim 5, including a seal for sealing water from said tube and the cavity for holding a weapon.

7. The launch apparatus according to claim 2, wherein said annularly disposed resilient means comprises resilient means for supporting a weapon over substantially its entire length.

8. The launch apparatus according to claim 6, wherein said annularly disposed resilient means comprises resilient means for supporting a weapon over substantially its entire length.

9. The launch apparatus according to claim 1, wherein said annularly disposed resilient means include adjustable prestressed means for variably prestressing said annularly disposed resilient means to hold a weapon within said tube with variability tension.

10. The launch apparatus according to claim 8, wherein said annularly disposed resilient means include adjustable prestressed means for variably prestressing said annularly disposed resilient means to hold a weapon within said tube with variability tension.

11. The launch apparatus according to claim 1, including centering means for mechanically centering a weapon in said tube at least during loading and firing this weapon subsequent to loading.

12. The launch apparatus according to claim 9, including centering means for mechanically centering a weapon in said tube at least during loading and firing this weapon subsequent to loading.

13. The launch apparatus according to claim 9, wherein said centering means for mechanically centering a weapon in said tube has means for centering a weapon during discharge thereof.

14. The launch apparatus according to claim 1, wherein said launching apparatus comprises at least one of: a torpedo launcher, a missile launcher and a mine launcher.

15. A launch apparatus for a submarine for launching a weapon, said launch apparatus comprising:

launch tube means having an exterior tube and an interior tube having a cavity for receiving a weapon;

said interior cavity having an inner surface region;

said launch tube means having means for mounting said launch tube means in a submarine;

means being disposed within said interior cavity in an annular space between said tube and a weapon and making contact with said inner surface region and also for making contact with and holding a weapon disposed in said tube;

said annularly disposed means comprising annularly disposed resilient means for resiliently holding a weapon within said interior cavity of said launch tube means; and resilient sealing means for at least partially sealing out water from around a weapon disposed in said tube, said resilient means for at least partially sealing water being for sealing out water at substantial diving depths of the submarine;

said resilient means for being disposed along a substantial portion of the length of the weapon for at least partially sealing water for forming an at least partially annular water free volume between said launch tube means and a weapon disposed in said launch tube means at least at substantial diving depths of the submarine, said water free volume for forming a cushion against high shock stresses of explosions;

said resilient means for sealing for being disposed within said exterior tube and in sealing contact with said interior tube to seal water from said interior tube.

16. The launch apparatus according to claim 15, wherein said annularly disposed resilient means comprises individual, shock damping elements.

17. The launch apparatus according to claim 15, wherein said seal means is a sleeve packing.

18. A launch apparatus for a submarine for launching a weapon, said launch apparatus comprising:

launch tube means having an interior cavity for receiving a weapon;

said interior cavity having an inner surface region;

said launch tube means having means for mounting said launch tube means in a submarine;

means being disposed within said interior cavity in an annular space between said tube and a weapon and making contact with said inner surface region and also for making contact with and holding a weapon disposed in said tube;

said annularly disposed means comprising annularly disposed resilient means for resiliently holding a weapon within said interior cavity;

said annularly disposed resilient means for being disposed along a substantial portion of the length of the weapon comprising means for at least partially sealing out water from around a weapon disposed in said tube, said means for at least partially sealing water being for sealing out water at substantial diving depths of the submarine over substantially the entire length of a weapon disposed in said tube;

said means for at least partially sealing water for forming an at least partially annular water free volume between said inner cavity and a weapon disposed in said launch tube means at least at substantial diving depths of the submarine, said water free volume for forming a cushion against high shock stresses of explosions.

* * * * *